US006427667B1

(12) United States Patent
Kato

(10) Patent No.: US 6,427,667 B1
(45) Date of Patent: Aug. 6, 2002

(54) FUEL INJECTOR MOUNTING ARRANGEMENT

(75) Inventor: Masahiko Kato, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/575,911

(22) Filed: May 23, 2000

(30) Foreign Application Priority Data

May 27, 1999 (JP) ..... 11-148459

(51) Int. Cl.[7] ..... F02M 55/02
(52) U.S. Cl. ..... 123/470; 277/591; 123/295
(58) Field of Search ..... 123/470, 472, 123/295, 430; 277/591, 597, 648

(56) References Cited

U.S. PATENT DOCUMENTS 3,770,285 A * 11/1973 Grover ..... 277/165
4,133,321 A * 1/1979 Hofmann et al. ..... 123/32 R
4,272,085 A * 6/1981 Fujikawa et al. ..... 277/235 B
4,589,596 A 5/1986 Stumpp et al.
4,647,012 A 3/1987 Gartner
5,044,340 A * 9/1991 Robnett ..... 123/470
5,345,913 A 9/1994 Belshaw et al.
5,706,787 A * 1/1998 Fujikawa ..... 123/470
5,752,487 A 5/1998 Harrell et al.

* cited by examiner

*Primary Examiner*—Willis R. Wolfe
*Assistant Examiner*—Mahmond Gimie
(74) *Attorney, Agent, or Firm*—Knobbe, Martens, Olson & Bear LLP

(57) ABSTRACT

A mounting arrangement for a fuel injector comprises a cylinder head, a mounting bore formed in the cylinder head, a seat surface formed within the mounting bore, a fuel injector positioned within the mounting bore and comprising a seating surface, at least one sealing ring disposed about a portion of the fuel injector and positioned between the seating surface and the seat surface. The ring comprises a thermal insulator material and a resin material. The ring also comprises a deformable eyelet that expands radially inward in response to compressive axial forces. The resin material thermally activates at a temperature within the operating temperature range of the engine.

31 Claims, 9 Drawing Sheets

FUEL INJECTOR MOUNTING ARRANGEMENT

PRIORITY INFORMATION

The present application is based on and claims priority to Japanese Patent Application No. 11-148459, filed May 27, 1999, the entire contents of which are hereby expressly incorporated by reference.

BACKGROUND OF THE INVENTION

1. Field of the Invention

The present invention generally relates to fuel injector mounting arrangements for direct injection engines. More particularly, the present invention relates to an improved injector mounting arrangement for use in such engines.

2. Related Art

Fuel injected engines come in a variety of types. For instance, in some fuel injected engines, the fuel injector is positioned within the intake passage to provide an air fuel mixture upstream of a combustion chamber. In other arrangements, a fuel injector may be mounted just outside of an intake valve and directed toward a combustion chamber such that the spray of fuel passes through the intake valve and mixes with the air within the combustion chamber. In other arrangements, the injector is positioned to inject fuel directly into a combustion chamber for mixing with air drawn in through an induction system. In such arrangements, the injector is subjected to high temperatures as well as thermal cycling.

In these direct injection engines, gases created during the combustion process sometimes leak around the fuel injectors mounted in the cylinder head. In addition, the flames created during the ignition of the air-fuel charge within the combustion chamber also force themselves within gaps formed within the mounting arrangement of a fuel injector. The migration of the flame, as well as the thermal conductivity of the materials used to mount the fuel injector and the fuel injector itself, can create a number of problems for proper operation of the fuel injector. For instance, a portion of the fuel injector proximate the tip of the fuel injector can become extremely heated, leading to the deposition of carbon deposits about the fuel injector. The formation of the carbon deposits often prohibits the smooth flow of fuel over time. As a result, the total amount of fuel being injected by the injector decreases, leading to rough idling and hesitation during acceleration. This problem is more common in two cycle engines or other types of engines that are run at high speeds and high temperatures.

With reference now to FIG. 1, an earlier fuel injector mounting arrangement is illustrated therein. In this illustrated arrangement, a fuel injector 10 includes a fuel injection nozzle 12 that extends through a portion of a cylinder head 14. The cylinder head 14 partially encloses a combustion chamber 16 into which the fuel passing through the fuel injector 10 is injected. As illustrated, the nozzle 12 extends through an opening 16 in the cylinder head 14 that is directly exposed to flames F that are propagated during the combustion of the air-fuel mixture within the combustion chamber 16. As illustrated in FIG. 1, a gap is defined between the side surface of the nozzle 12 and the opening 18. Therefore, flames directly impinge upon portions of the fuel injector nozzle 12 and increase the temperature of the nozzle 12.

A seal 20 is disposed between the nozzle 12 and a stopping surface 22 of the injector 10. In addition, the seal 20 seats against a lower surface which forms a seat 24 for the seal 20 on the cylinder head 14. The illustrated seal 20 has been curved, which creates a slight gap between its innermost end 26 and the nozzle 12. Thus, the nozzle is further exposed to flames that pass within the gap defined between the nozzle 12 and the cylinder head 14. Moreover, the seal 20 typically is constructed of metal. Therefore, its thermal conductivity is high.

Because the intense heat within the combustion chamber 16 is transmitted to the fuel injector 10, the temperature of the nozzle 12 often has a high temperature as well. Accordingly, heavy substances or components of the fuel are deposited and accumulate around the tip of the fuel injector 10. More particularly, the fuel injector 10 includes a needle valve 28 that controls the flow of fuel through the injector 10. Moreover, the fuel injector 10 includes a swirler 30 as well as a valve seat 32. When the needle valve 28 is seated on the valve seat 32, fuel does not flow through the injector. However, when the needle valve 28 is withdrawn from the valve seat 32, fuel is allowed to flow past the swirler 30 through an injection port 34. When the temperature of the injector nozzle 12 is increased, deposits D typically form about the injection port 34. These deposits inhibit the smooth flow of fuel through the injector port 34 when the needle valve 28 is retracted from the valve seat 32. In addition, under extreme circumstances, the deposits D can form up through the injector port 34 onto a portion of the valve seat 32 such that the needle valve 28 does not properly seat against the valve seat 32, leading to a slow trickle of fuel that can cause dieseling during engine shut-down.

SUMMARY OF THE INVENTION

Accordingly, an improved injector mounting arrangement is desired. Preferably, the mounting arrangement reduces the propagation of flames along the sides of the nozzle 12 of the fuel injector 10. In addition, the mounting arrangement preferably seals the sides of the injector nozzle from both combustion gas propagation as well as flame propagation. Moreover, in some arrangements, the seals preferably thermally insulate at least a portion of the injector from the heat being generated within the combustion chamber.

Accordingly, one aspect of the present invention involves a sealing ring for a fuel injector mounting arrangement in which a fuel injector is mounted for direct injection into a combustion chamber. The ring comprises a first layer of heat insulating material and a second outer layer of a thermally activatable material.

Another aspect of the present invention involves a direct injected engine comprising a cylinder, a cylinder head being mounted to said cylinder and a piston being disposed within said cylinder. A combustion chamber is defined at least in part by said piston, said cylinder and said cylinder head. A mounting bore extends through said cylinder head with a fuel injector depending through said mounting bore. The mounting bore includes a stepped seat surface. The fuel injector comprises a nozzle extending between a tip and a seating surface. The nozzle comprises a fuel injection port that is disposed at the tip to inject fuel directly into said combustion chamber. At least one sealing ring is disposed between said about said fuel injector between said seating surface and said seat surface. The sealing ring comprises a thermal insulating component and has a smaller outer diameter than an outer diameter of said seat surface.

A further aspect of the present invention involves a method of sealing a fuel injector within a cylinder head. The method comprises placing at least one sealing ring into a mounting bore of said cylinder head, positioning a fuel injector through said sealing ring, applying a compressive force to secure said fuel injector in position within said mounting bore, and heating said cylinder head to melt a component of said ring.

BRIEF DESCRIPTION OF THE DRAWINGS

These and other features, aspects and advantages of the present invention will now be described with reference to the drawings of several preferred embodiments, which embodiments are intended to illustrate and not to limit the present invention, and in which drawings.

DETAILED DESCRIPTION OF THE PREFERRED EMBODIMENTS OF THE INVENTION

Figure 1:
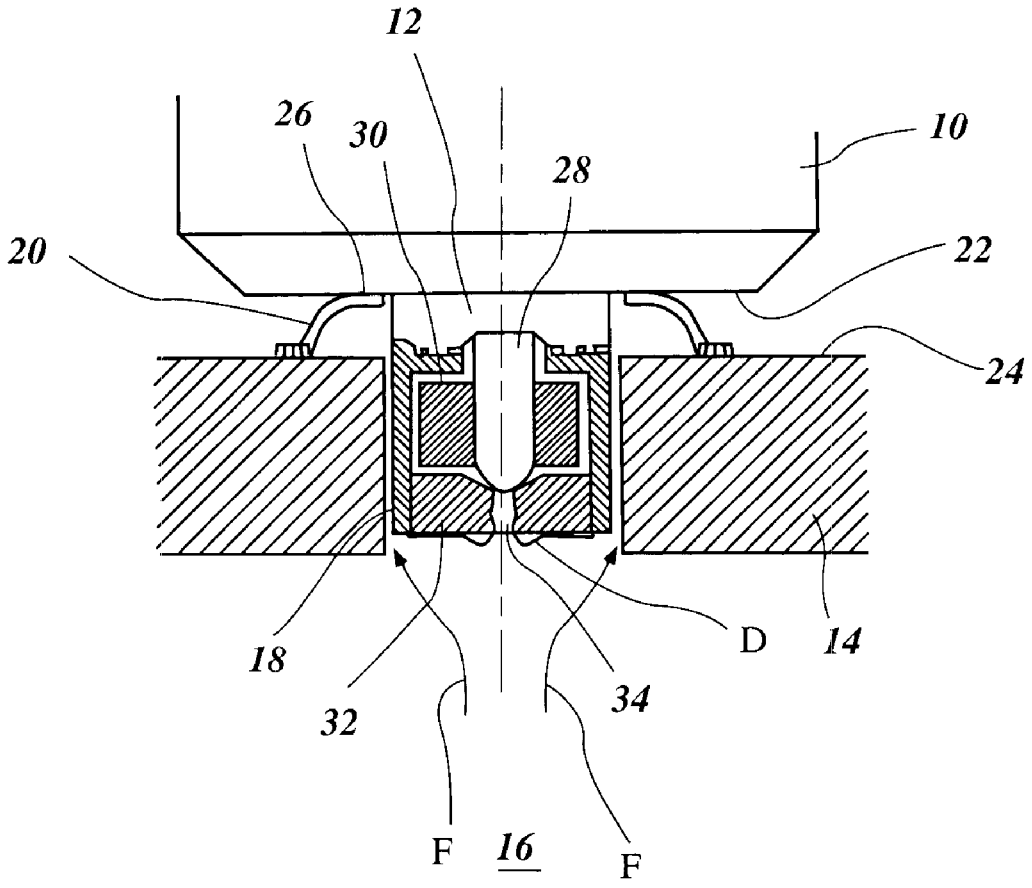
Figure 1 Prior Art
FIG. 1 is a prior art fuel injector mounting arrangement featuring a cup seal extending about a portion of a nozzle of the fuel injector.
Figure 2:
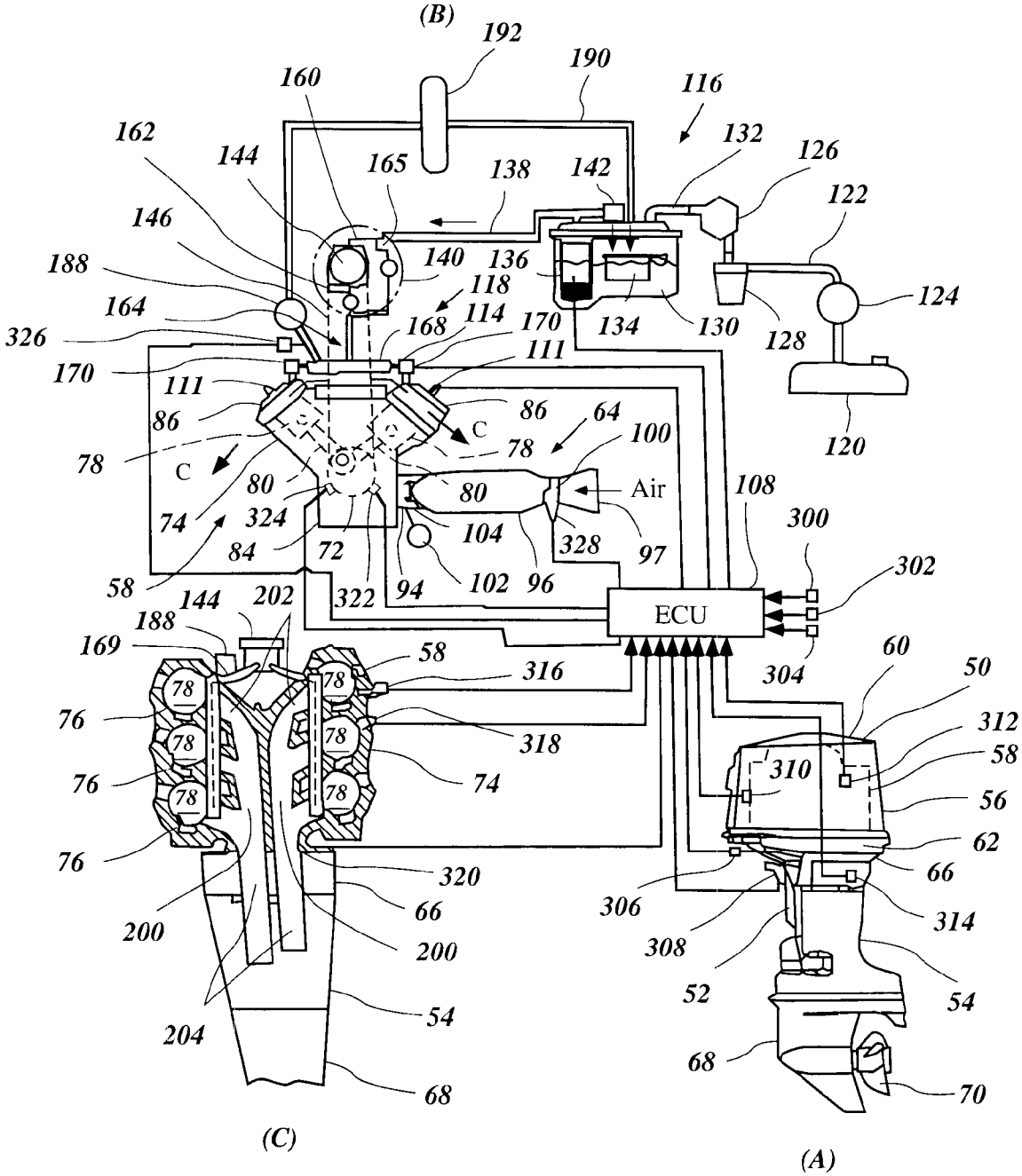
FIG. 2 is a multi-part view showing: (A) in the lower right hand portion, a side elevation view of an outboard motor employing certain features, aspects and advantages of the present invention; (B) in the upper view, a partially schematic view of the engine of the outboard motor with its induction and fuel injection system shown in part schematically; and (C) in the lower left hand portion, a rear elevation view of the outboard motor with portions removed and other portions broken away and shown in section along the line C—C in the upper view B so as to more clearly show the construction of the engine. An ECU (electric control unit) for the motor links the three views together.

With reference now to FIG. 2, an outboard motor with a fuel supply system having certain features, aspects and advantages of the present invention will be described. While the present invention will be described in the context of the outboard motor, it is anticipated that the present fuel injector mounting arrangement can have utility in other environments of use. For instance, the fuel injector mounting arrangement can be used in any vehicular application featuring a fuel injection system. Moreover, the present fuel injector mounting arrangement can also be used in stationary engines such as those found on generators, for instance.

In the lower right hand view of FIG. 2 (i.e., FIG. 2(A)), the outboard motor is depicted in side elevation view and is identified generally by the reference numeral 50. The outboard motor 50 preferably includes a clamping arrangement 52. The clamping arrangement 52 is used to attach the outboard motor 50 to the hull of the watercraft (not shown) in any manner known to those of ordinary skill in the art. The outboard motor 50 preferably is connected to the hull of the watercraft such that it may be steered about a generally vertical axis and tilted or trimmed about a generally horizontal axis.

The outboard motor 50 generally comprises a drive shaft housing 54 and a powerhead 56, which is positioned generally above and generally is supported by the 40 drive shaft housing 54. The powerhead 56 preferably includes a powering internal combustion engine, which is indicated generally by the reference numeral 58. The engine 58 is also shown in the remaining two views of FIG. 2 (i.e., FIGS. 2(B) and 2(C)) and, therefore, will be described in more detail below with reference to these portions of FIG. 2.

The illustrated powerhead 56 generally includes a protective cowling which comprises a main cowling portion 60 and a lower tray portion 62. The main cowling portion 60 preferably includes a suitable air inlet arrangement (not shown) to introduce atmospheric air into the interior of the protective cowling. The air present within the protective cowling can then be drafted into an engine intake system or induction system, which is generally indicated by the reference numeral 64 (see FIG. 2(B)) and, which will be described in greater detail directly below.

The main cowling portion 60 preferably is detachably connected to the lower tray portion 62 of the powerhead 56. The detachable connection preferably is generally positioned proximate an exhaust guide plate 66. The exhaust guide plate 66 encircles an upper portion of the drive shaft housing 54 and forms a portion of an exhaust system, which will be described below. Positioned beneath the illustrated drive shaft housing 54 is a lower unit 68 in which a propeller 70 is journaled for rotation. As these constructions are well known to those of ordinary skill in the art, further description of them is deemed unnecessary.

As is typical with outboard motor practice, the illustrated engine 58 is supported in the powerhead 56 so that a crankshaft 72 (see FIG. 2(B)) can rotate about a generally vertically extending axis. The vertical mounting of the crankshaft facilitates the connection of the crankshaft 72 to a driveshaft (not shown) that depends into and through the driveshaft housing 54. The driveshaft drives the propeller 70 through a forward, neutral and reverse transmission (not shown) contained in the lower unit 68. Of course, other suitable types of transmissions also can be used with certain features, aspects and advantages of the present invention.

With reference now to FIG. 2(C), the illustrated engine 58 is of the V6 type and operates on a 2-stroke crankcase compression principle. Although the present fuel injector mounting arrangement is primarily described in conjunction with an engine having this cylinder number and this cylinder configuration, it will be readily apparent to those of ordinary skill in the art that the present fuel injector mounting arrangement can be utilized with engines having other cylinder numbers and other cylinder configurations. For instance, the cylinders can be arranged and aligned in some arrangements, and the engine can comprise as few as one or more than eight cylinders in various arrangements. Moreover, certain features of the present fuel injector mounting arrangement also may find utility with engines operating on other operating principles, such as a rotary principle and a 4-cycle principle.

With reference now to FIG. 2(B), the illustrated engine 58 is generally comprised of a cylinder block 74 that is formed with a pair of cylinder banks. Each of these cylinder banks preferably is formed with three vertically spaced horizontally-extending cylinder bores 76. In some arrangements, separate cylinder bodies can be used in place of the cylinder block that accommodates more than one cylinder bore. For instance, each cylinder body may accommodate but a single cylinder bore and a number of cylinder bodies can be aligned side by side yet be formed separate from one another.

A set of corresponding pistons 78 preferably are arranged and configured to reciprocate within the cylinder bores 76. The illustrated pistons 78 in turn are connected to the small ends of connecting rods 80. The big ends of the connecting rods 80 preferably are journaled about the throws of the crankshaft 72 in a well known manner.

With continued reference to FIG. 2(B), the illustrated crankshaft 72 is journaled in any suitable manner for rotation within a crankcase chamber (not shown). Desirably, the crankcase chamber (not shown) is formed, at least in part, by a crankcase member 84 that may be connected to the cylinder block 74 or the cylinder bodies in any suitable manner. As is typical with 2-stroke engines, the illustrated crankshaft 72 and the crankcase chamber (not shown) preferably are formed with dividing seals or dividing walls such that each section of the crankcase chamber (not shown) associated with one of the cylinder bores 76 can be sealed from the other sections that are associated with other cylinder bores. This type of construction is well known to those of ordinary skill in the art.

Figure 3:
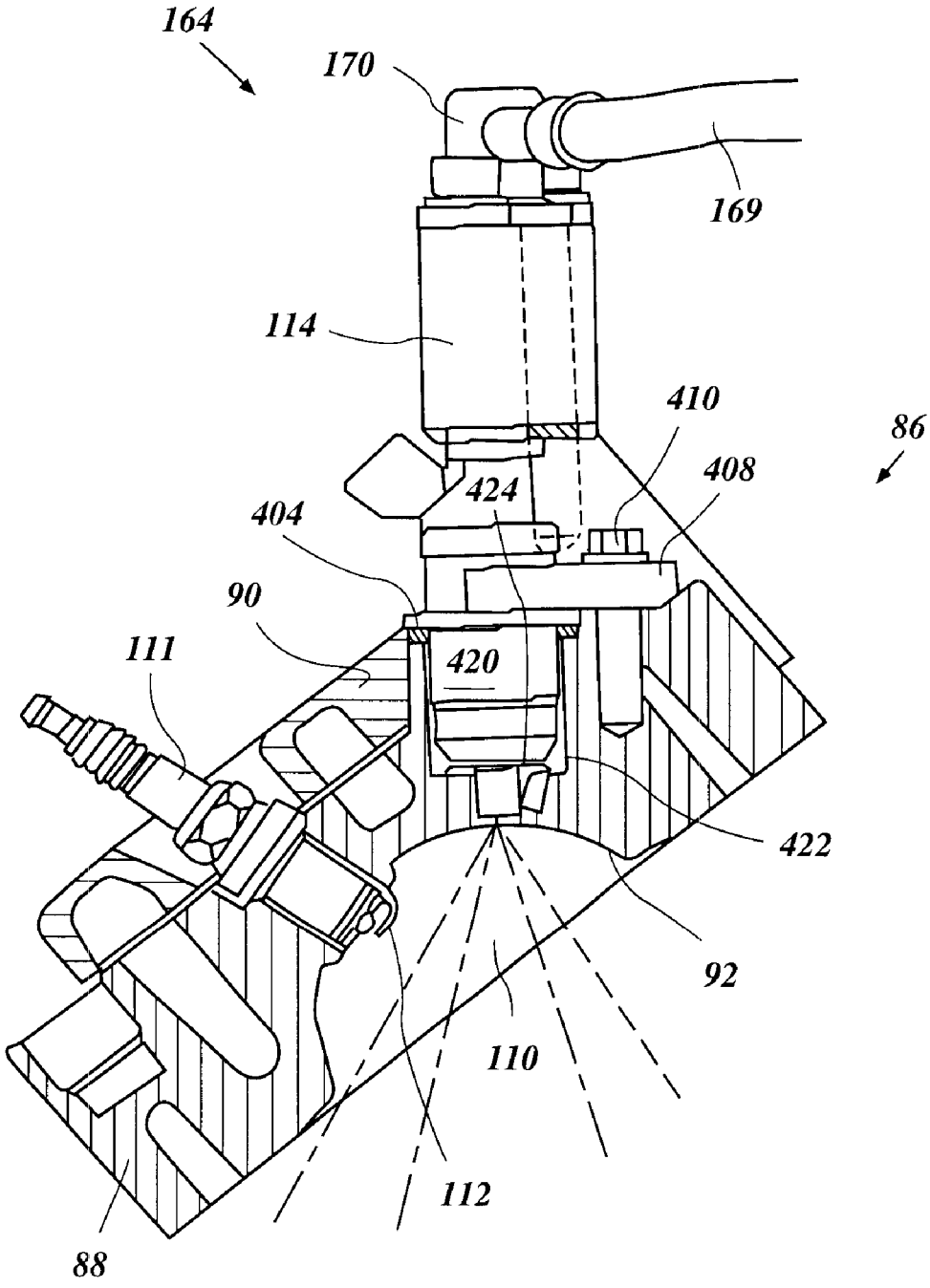
FIG. 3 is an enlarged partially sectioned side elevation view of a fuel injector and spark plug positioned within a cylinder head of the engine of FIG. 2.

With reference now to FIG. 2(B), a cylinder head assembly, indicated generally by the reference numeral 86, preferably is connected to an end of each of the cylinder banks that is spaced from the crankcase member 84. With reference now to FIG. 3, each cylinder head assembly 86 generally is comprised of a main cylinder head member 88 and a cylinder head cover member 90. The cylinder head cover member 90 is attached to the cylinder head member 88 in any suitable manner. As illustrated in FIG. 3, the cylinder head member 88 preferably includes a recess 92 that corresponds with each of the cylinder bores 76. As will be appreciated, each of the recesses 92 cooperates with a respective cylinder bore 76 and a head of a reciprocating piston 78 to define a variable volume combustion chamber in the illustrated arrangement. The cylinder head member 90 completes the illustrated cylinder head assembly and includes a number of ports for mounting of various components into the combustion chamber. As will be recognized by those of ordinary skill in the art, the cylinder head components 88, 90 preferably are secured to each other into the respective cylinder banks using any suitable manner.

With reference again to FIG. 2(B), the air induction system 64 is provided for delivering an air charge to the sections of the crankcase chamber (not shown) associated with each of the cylinder bores 76. In the illustrated arrangement, communication between the sections of the crankcase chamber and the air contained within the cowling occurs at least in part via an intake port 94 formed in the crankcase member 84. The intake port 94 can register with a crankcase chamber section corresponding to each of the cylinder bores 76 such that air can be supplied independently to each of the crankcase chamber sections. Of course, other arrangements are also possible.

The induction system 64 also includes an air silencing and inlet device, which is shown schematically in FIG. 2(B), indicated generally by the reference numeral 96. In one arrangement, the device 96 is contained within the cowling member 60 at the cowling's forward end and has a rearwardly-facing air inlet opening (not shown) through which air is introduced into the silencer 96. Air can be drawn into the silencer 96 from within the cowling 60 via an inlet opening 97.

The air inlet device 96 supplies the induced air to a plurality of throttle bodies, or induction devices, 100. Each of the throttle bodies 100 preferably has a throttle valve provided therein. The illustrated throttle valves are desirably supported on throttle valve shafts that are linked to each other for simultaneous opening and closing of the throttle valves in a manner that is well known to those of ordinary skill in the art. It is anticipated, however, that a single supply passage can extend to more than one or even all of the chambers such that the number of throttle valves can be one or more than one depending upon the application.

Lubricant pumps 102 preferably are provided for spraying lubricant into the air inlet device 96 for lubricating moving components of the engine 58 in manners well known to those of ordinary skill in the art. Preferably, the lubricant pumps 102 are controlled by an ECU 108, which will be described in more detail later. In addition, although it is not shown, some forms of direct lubrication can be employed for delivery of lubricant directly to certain components of the engine 58.

As is typical in 2-cycle engine practice, the illustrated intake ports 94 include reed-type check valves 104. The check valves 104 permit inducted air to flow into the sections of the crankcase chamber when the pistons 78 are moving upwardly in their respective cylinder bores 76. The reed-type check valves 104, however, do not permit back flow of the air. Therefore, as the pistons 78 move downwardly within the respective cylinder bores 76, the air charge will be compressed in the sections of the crankcase chamber. As is known, the air charge is then delivered into the combustion chamber 110 through suitable scavenge passages (not shown). This construction is well known to those of ordinary skill in the art.

With reference now to FIG. 3, a spark plug 111 is mounted within the cylinder head 86 and has an electrode 112 disposed within the combustion chamber 110. The spark plug 111 is fired under the control of the ECU 108 in any suitable manner. For instance, the ECU 108 may use a CDI system to control ignition timing according to any of a number of control routines known to those of ordinary skill in the art. The spark plug 111 ignites an air-fuel charge that is formed by mixing the fuel directly with the intake air provided in the combustion chamber 110 as described above.

The fuel is preferably provided via respective fuel injector 114. This is schematically illustrated in FIG. 3. The fuel injectors 114 preferably are of the solenoid type and preferably are electronically or electrically operated under the control of the ECU 108. As with the ignition system, the fuel injection system can be controlled by the ECU according to any of a number of suitable control strategies. The control of the fuel injectors 114 can include the timing of the fuel injector injection cycle, the duration of the injection cycle, and other operating parameters of the fuel injector 114.

As illustrated in FIG. 3, the fuel injector 114 preferably is mounted directly in the cylinder head 86 in a location that provides optimal fuel vaporization or diffusion under all or most running conditions. Of course, other mounting positions can also be used. For instance, various locations about the cylinder head 86 can be used, as well as positioning the fuel injector 114 within an intake passage leading into this combustion chamber 110 in a 4-cycle application, for instance.

With reference again to FIG. 2(B), fuel is supplied to the fuel injectors 114 by a fuel system which features a low pressure portion 116 and a high pressure portion 118. The low pressure portion 116 includes a main fuel supply tank 120 that can be provided in the hull of the watercraft with which the outboard motor 50 is associated. Fuel can be drawn from this tank 120 through a supply conduit 122 using a first low pressure pump 124. In some arrangements, a plurality of secondary low pressure pumps 126 also can be used to draw the fuel from the fuel tank 120. The pumps can be manually operated pumps, diaphragm-type pumps operated by variations in pressure in the sections of the crankcase chamber, or any other suitable type of pump. Preferably, the pumps 124, 126 provide a relatively low pressure draw on the fuel supply. In addition, in the illustrated arrangement, a fuel filter 128 is positioned along the conduit 122 at an appropriate location within the main cowling 60 such that the fuel filter may be easily serviced.

For the secondary low pressure pumps 126, the fuel is supplied to a prepressurized or low pressure vapor separator 130. The vapor separator 130 can be mounted on the engine 58 in any suitable location. In addition, in some arrangements, the vapor separator 130 is separate from the engine, but positioned within the cowling portion 60 at an appropriate location. The fuel is supplied to the vapor separator 130 through a supply line 132. At the vapor separator end of the supply line 132, there preferably is provided a valve which is not shown that can be operated by a float 134 so as to maintain a substantially uniform level of fuel in the vapor separator tank 130.

A fuel pump 136 can be provided in the vapor separator 130 and can be controlled by ECU 108 in any suitable manner. In the illustrated arrangement, the connection between the ECU 108 and the fuel pump 136 is schematically illustrated with the line. While the schematic illustration shows a hard wired connection should be appreciated by those of ordinary skill in the art that other electrical connections, such as infrared radio waves and the like can be used. This description of the connection between the ECU and the fuel pump 136 will also apply to a variety of components which are also connected to the ECU 108 and will be described below.

The fuel pump 136 preferably pre-pressurizes the fuel that is delivered through a fuel supply line 138 to a high pressure pumping apparatus 140. The fuel pump 136, which can be driven by an electric motor in some arrangements, preferably develops a pressure of about 3–10 kg per $cm^2$. A low pressure regulator 142 can be positioned along the line 138 proximate the vapor separator 130 to limit the pressure of the fuel that is delivered to the high pressure pumping apparatus 140 by dumping some portion of the fuel back into the vapor separator 130. This is illustrated by the lines in FIG. 2(B).

The illustrated high pressure fuel delivery system 140 includes a high pressure fuel pump 144 that can develop a pressure of, for example, 50–100 kg per $cm^2$ or more. A pump drive unit 146 preferably is provided for driving the high pressure fuel pump 144. Of course, any other suitable driving arrangement can also be used.

The high pressure fuel pump 144 preferably includes a fuel inlet and outlet module. The inlet and outlet module (not shown) can include an inlet passage 160 connected with the line 138 and an outlet passage 162 that is connected with a fuel injector supply system indicated generally at 164, and an overflow passage connected back to a low pressure side of the high pressure fuel pump 144. The overflow passage is indicated with the reference numeral 165.

Fuel can be supplied from the high pressure pump 144 to the fuel injector supply system 164 through the supply passage 162. The illustrated fuel injector supply system generally is comprised of a main fuel manifold 168 that extends substantially horizontally. The main fuel manifold 168 in turn delivers fuel to a pair of generally vertically-extending fuel rails 170 in the illustrated arrangement. The fuel rails 170 preferably deliver fuel to the fuel injectors 114. This is better illustrated in FIG. 3. As illustrated, a high pressure hose 169 which can be positioned either between the fuel rail 170 and the fuel manifold 168 or between the high pressure pump 144 and the fuel rail 170 provides fuel to the fuel rail 170. The fuel from the fuel rail 170 is then provided to the fuel injector in any suitable manner.

In the illustrated arrangement, pressure of the fuel supplied by the fuel pump 144 to the fuel injectors 114 is regulated to a generally fixed value by a high pressure regulator 188 which dumps fuel back to the vapor separator 130 through a pressure relief line 190 in which a fuel heat exchanger or cooler 192 is provided. Generally, the fuel is desirably kept under constant or substantially constant pressure so that the volume of injected fuel can be at least partially determined by changes of duration of injection under the condition that the pressure for injection is always approximately the same.

After the charge is ignited, burns and expands, the pistons 78 are driven downwardly in the respective cylinder bores 76 until the pistons 78 reach a lower-most position. During the downward movement of the pistons 78, the exhaust ports (not shown) are uncovered by the piston 78 to allow communication between the combustion chamber 110 and an exhaust system. The illustrated exhaust system features an exhaust manifold section 200 for each of the cylinder banks. A plurality of runners 202 extend from the cylinder bore 76 into the manifold collectors 200. The exhaust gases flow through the branch pipes 202 into the manifold collector section 200 of the respective exhaust manifolds that are formed within the cylinder block in the illustrated arrangement. The exhaust manifold collector sections 200 then communicate with exhaust passages formed in exhaust guide plate 66 on which the engine 58 is mounted.

A pair of exhaust pipes 204 depend from the exhaust guide plate 66 and extend the exhaust passages into an expansion chamber (not shown) formed within the drive shaft housing 54. From this expansion chamber, the exhaust gases are discharged to the atmosphere through a suitable exhaust outlet. As is well known in the outboard motor practice, the suitable exhaust outlet may include an under water, high speed exhaust gas discharge and an above the water, low speed exhaust gas discharge. Because these types of systems are well known to those of ordinary skill in the art, a further description of them is not believed to be necessary to permit those of ordinary skill in the art to practice the present invention.

As indicated above, the ECU 108 samples a variety of data for use in performing any of a number of control strategies. Because these control strategies are outside the scope of the present invention, the control strategies will not be discussed. However, the sensors from which data is input will be introduced. The illustrated ECU 108 receives input from a watercraft speed sensor 300 which preferably is mounted on a portion of the watercraft to indicate the speed of the watercraft through the body of water in which the watercraft is operating. The ECU 108 also receives input from the watercraft position sensor 302. The watercraft position sensor 302 preferably indicates the water level on the outside of the watercraft such that the degree of submergence of the watercraft can be ascertained by the ECU 108. The ECU 108 also receives an input from an atmospheric pressure sensor 304. The atmospheric pressure sensor 304 inputs a value corresponding to the pressure in which the watercraft is operating.

With reference now to FIG. 2(A), the ECU 108 also receives input from an engine mount height sensor 306. The engine height mount sensor 306 indicates to the ECU 108 the relative height between the engine or the outboard motor 50 and the watercrafts to which the outboard motor 50 is mounted in addition, the ECU 108 receives a signal from a trim angle sensor 308. As is known, the trim angle sensor 308 sends a signal to the ECU 108 that is indicative of the tilt or trim angle of the outboard motor 50 relative to the watercraft on which the outboard motor 50 is mounted.

With continued reference to FIG. 2(A), the outboard motor 50 also features an engine vibration sensor 310 which indicates to the ECU 108 the extent of vibrations set up by the outboard motor 50 and more particularly, the engine 58 operating within the outboard motor 50. In addition, the ECU 108 receives a signal from a coolant temperature sensor 312 that indicates the temperature of the coolant being circulated through the engine 58. The ECU 108 also receives an input from a transmission shift sensor 314. The transmission shift sensor 314 outputs a signal to the ECU 108 indicative of a drive state of the transmission. For instance, the sensor 314 can output a signal indicative of the transmission being in a neutral arrangement or in a forward or reverse driving arrangement.

With reference now to FIG. 2(C), the engine 58 also includes an oxygen sensor 316. The oxygen sensor 316 outputs a signal to the ECU 108 representative of the oxygen content within the exhaust gas flow. As is known to those of ordinary skill in the art, the content of oxygen within the exhaust flow can be used to determine how complete the combustion occurring within the combustion chamber 110 actually is. The engine 58 also includes an engine temperature sensor 318 that outputs a signal to the ECU 108 indicative of the temperature of the engine during operation. Moreover, the engine 58 includes a back pressure sensor 320 positioned along the exhaust system to indicate the back pressure being developed within the exhaust system of the engine 58. As will be recognized by those of ordinary skill in the art, the back pressure developed within the exhaust system can vary depending upon the depth of the underwater discharge and whether the above water discharge becomes submerged.

With reference now to FIG. 2(B), the engine also features a pair of sensors to determine the engine operating speed and the specific cylinder being fired at any particular time. In the illustrated arrangement, the engine includes a crankshaft speed sensor 322 which outputs a signal to the ECU 108 indicative of a rotational speed of the crankshaft. As is known, the rotational speed of the crankshaft 322 corresponds to the engine speed. In addition, the engine 58 includes a cylinder identification sensor 324. The cylinder identification sensor 324 transmits a signal to the ECU 108 that indicates which cylinder is being fired at what time during operation of the engine 58. As will be recognized by those of ordinary skill in the art, in some applications, a single sensor can be used to both indicate which cylinder is operating as well as the engine speed.

The fuel supply system also includes a pressure sensor 326. The pressure sensor 326 preferably is positioned between the fuel rail or fuel supply manifold 168 and the pressure regulator 188. The pressure sensor 326 provides a signal to the ECU 108 which is indicative of the pressure within the fuel supply system. Moreover, the air induction system includes a sensor 328 that outputs a signal to the ECU 108 which is indicative of a throttle opening angle. This signal can also be used to determine the speed of change of the throttle angle.

While the control system generally comprises the ECU 108 and the above listed sensors which sense various operating conditions for the engine, as well as ambient conditions and/or conditions of the outboard motor that may affect general engine performance, other sensors can also be used with the present invention. While certain of the sensors have been shown schematically in FIG. 2, and were described with reference to that figure, it should be readily apparent to those of ordinary skill in the art that other types of sensing arrangements also can be provided for performing the same functions and/or different functions. Moreover, it is also practicable to provide other sensors, such as an engine knock sensor, a watercraft pitch sensor, and an atmospheric temperature sensor in accordance with various control strategies. Of course, the signals, while being depicted with wire connections, also can be transmitted using radio waves, infrared transmitter and receiver pairs, and other suitable or similar techniques.

The ECU 108, as has been noted, outputs signals to the fuel injectors 114, the spark plugs 111 and a portion of the fuel injector supply system, such as the fuel pump 136 for their respective control. These control signals are indicated schematically in FIG. 2. Again, these signals can be transmitted in any suitable manner such as those described above.

Having described an exemplary outboard motor and internal combustion engine with which the present invention finds utility, the present invention will now be described with reference to FIGS. 3–13. It should be noted, however, that while the present invention has been described in the context of a 2-stroke powered outboard motor, the present invention can also find utility in gasoline, diesel, and other fuel supplied engines that run on the 2-stroke, 4-stroke, and/or rotary operational principles.

Figure 4:
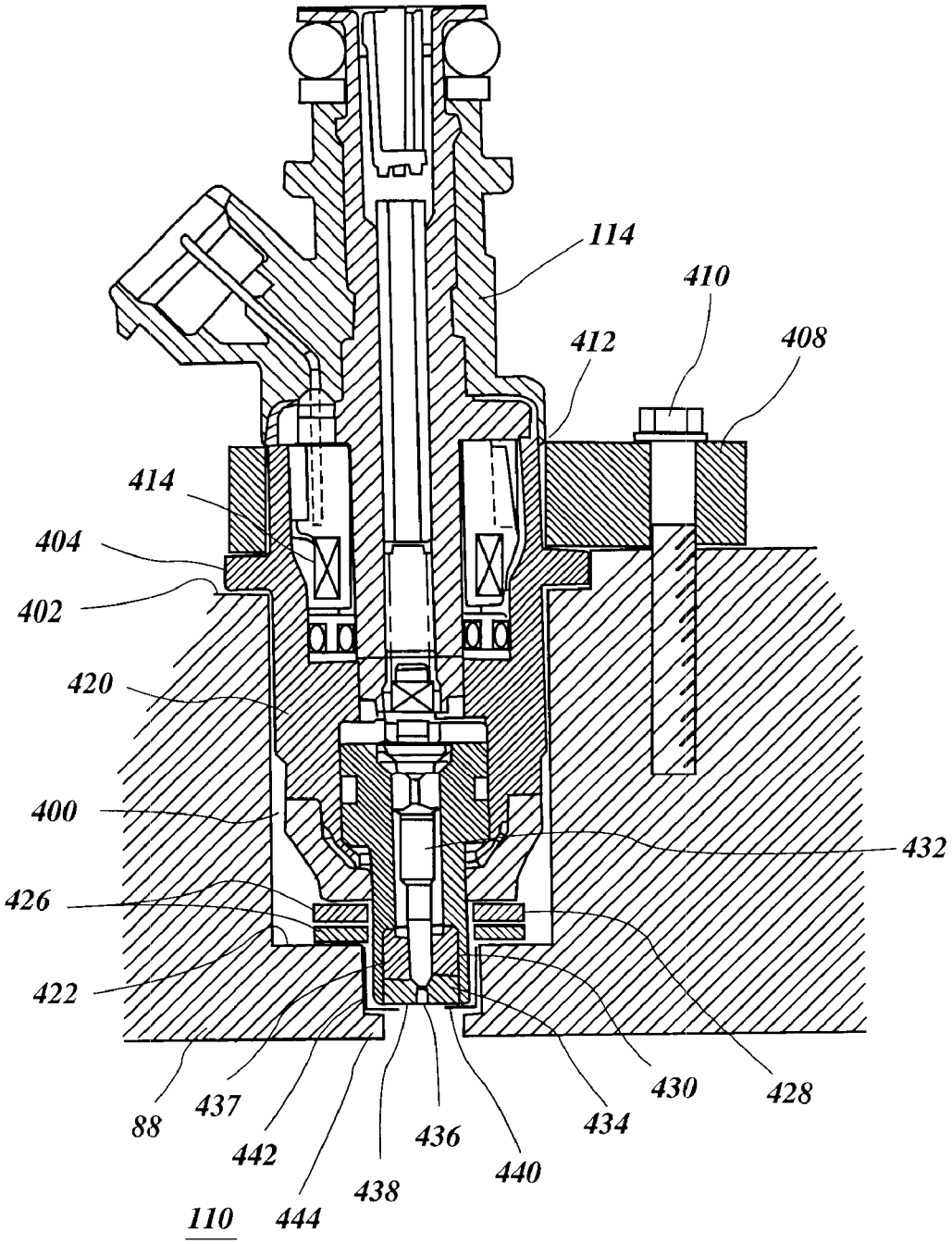
FIG. 4 is a further enlarged cross-sectioned view of a fuel injector mounted to the cylinder head in accordance with certain features, aspects and advantages of the present invention.

With reference now to FIG. 3, a presently preferred arrangement of the fuel injector mounting arrangement is illustrated therein. As illustrated, the fuel injector 114 is mounted to inject fuel directly into the combustion chamber 110. With reference now to FIG. 4, the illustrated cylinder head is formed with a stepped bore 400 through which the fuel injector 114 depends. The illustrated bore 400 includes three steps, however, other arrangements also can be used. Advantageously, the illustrated three steps aid in mounting and protecting the fuel injector 114 in manners that will be described.

Preferably, the mounting bore 400 includes an upper most step 402, which provides a level surface on which a collar portion 404 of the illustrated fuel injector 114 is supported. Specifically, during manufacture, a cast cylinder head can have a small amount of material removed to form the generally smooth and level mounting surface defined by the upper most step 402, in the illustrated arrangement. In some arrangements, a seal (not shown) can be positioned between the step 402 and the collar 404.

The illustrated arrangement also features a clamp 408 that cooperates with the cylinder head 88 to secure the fuel injector in position. The clamp 408 advantageously provides a counterforce to an upwardly directed force caused by the increased pressure developed within the combustion chamber 110 during operation of the engine. The clamp 408 is secured in position using a threaded fastener 410 in the illustrated arrangement. Of course, other suitable mounting arrangements also can be used. Desirably, the clamp 408 extends about at least a portion of the fuel injector and, in the illustrated arrangement, encircles about half of a body case portion 412 of the fuel injector that extends outward (i.e., away from the combustion chamber 110) from the collar portion 404. The illustrated clamp 408, thus, forms a yoke about at least a portion of the fuel injector 408.

With reference to FIG. 4, the illustrated fuel injector 114 is preferably driven to inject fuel using a solenoid 414. Thus, the charge forming device in the illustrated engine comprises solenoid-driven fuel injectors. Of course, the present invention can also be used with other types of fuel injectors. For instance, accumulator fuel injectors also can be mounted in accordance with certain features, aspects and advantages of the present invention.

With reference again to FIG. 3, a portion of the mounting bore 400 receives a lower portion 420 of the fuel injector 114. The illustrated mounting bore includes an intermediate step, or injector seat, which is generally indicated by reference numeral 422. A seal 424 preferably is positioned between a portion of the fuel injector 114 and the seat 422. As will be explained below, the illustrated seal generally comprises at least one and, preferably, at least two sealing rings 426. In the illustrated arrangement, the ring or rings 426 are disposed between the seat 422 and a contact surface 428 of the fuel injector 114. In addition, in the illustrated arrangement, the seals are disposed about a nozzle portion 430 of the fuel injector 114, which portion 430 houses at least a portion of a flow metering needle 432 of the fuel injector 114.

The needle 432 of the fuel injector 114 selectively seats on a valve seat 434 in the illustrated arrangement. When the needle 432 is in contact with the seat 434, fuel flow through a fuel injection port 436 of the fuel injector 114 is stopped. Conversely, when the illustrated needle 432 is removed from the seat 434, such as when the needle is moved by the motive forces of the solenoid 414, fuel is free to flow from a high pressure portion of the fuel supply system into the combustion chamber through the fuel injection port 436. The fuel flows past a swirler 437, such as those generally known in the art. The illustrated fuel injection port desirably is formed within the tip 438 of the fuel injector 114. The port can be sized, shaped and positioned in any suitable manner, such as those which are well-known to those having ordinary skill in the relevant arts.

Figure 5:
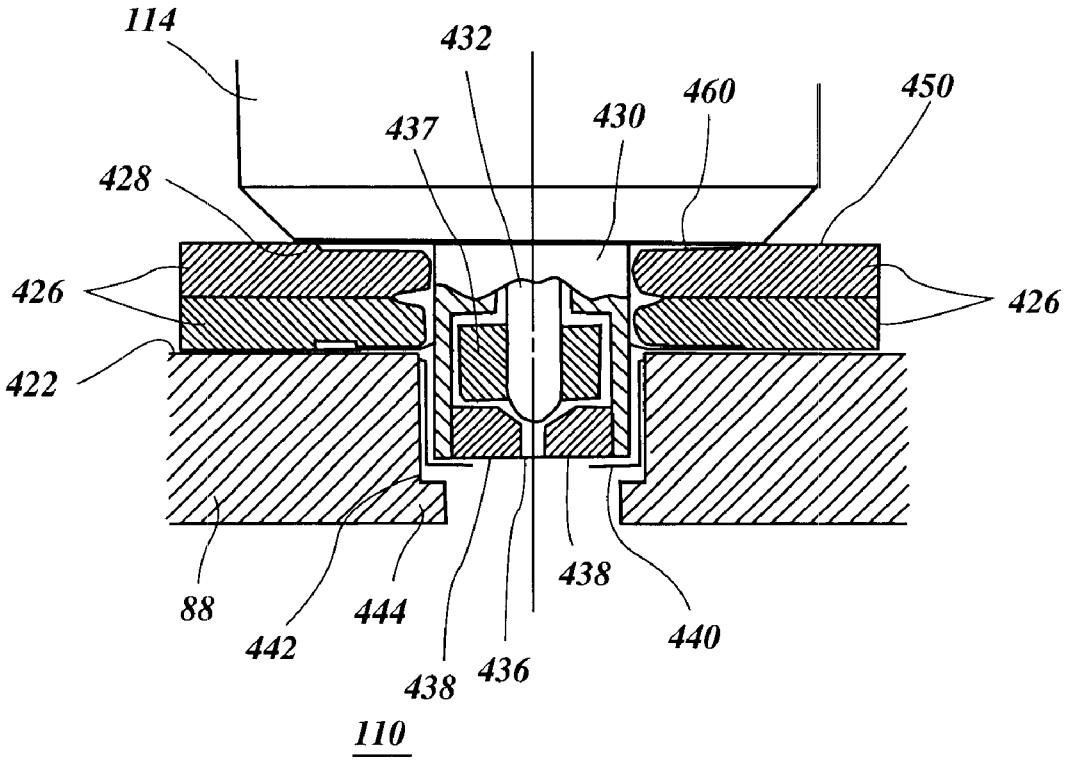
FIG. 5 is a yet further enlarged cross-sectioned view of the fuel injector mounting arrangement of FIG. 4.

With continued reference to FIGS. 4 and 5, a cap 440 preferably substantially encases at least a portion of the tip 438 and the nozzle portion 430 of the fuel injector. The cap 440, which will be described below in greater detail, forms an insulating shield from the extreme temperature fluctuations that occur immediately following ignition or detonation of the air-fuel charge contained within the combustion chamber 110. Preferably, the cap 440 is contained substantially within a sub-bore portion 442 of the mounting bore 400. More preferably, the sub-bore portion 442 is defined between a first step or stopper 444 and a second step, which is the seat 422 in the illustrated arrangement. In this arrangement, the cap 440 generally forms a sleeve that extends through the sub-bore 422 and substantially encases the lower nozzle portion of the fuel injector. Moreover, the seals 426 are disposed above the upper extremity of the illustrated cap 440.

Figure 6:
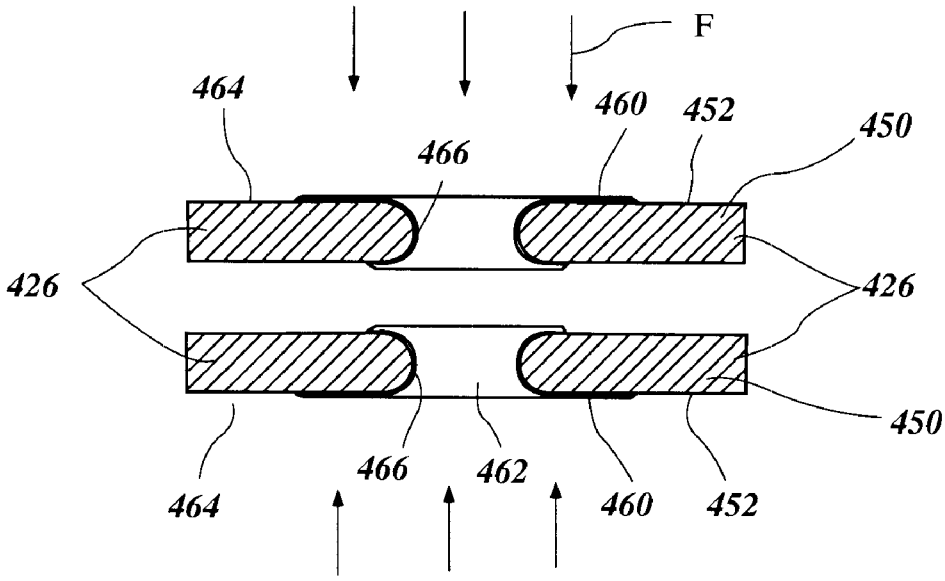
FIG. 6 is a sectioned side elevation view of a pair of sealing rings having certain features, aspects and advantages in accordance with the present invention.

With reference now to FIG. 6, a presently preferred construction of the illustrated seals 426. Each of the illustrated seals is generally constructed of a sheet material 450, which preferably has a high insulation value. For instance, in the illustrated arrangement, the sheet material 450 is asbestos or a suitable asbestos substitute. The sheet material 450 preferably is at least partially covered with a resin layer 452. In the illustrated arrangement, the sheet material 450 is completely encased within the resin layer 452; however, as will be recognized, in some applications, a portion of the sheet material is covered. For instance, in some applications, the surface of the sheet material that will be in contact with either the seat 422 or the sealing surface 428 of the fuel injector 114 will receive the resin material.

Figure 7:
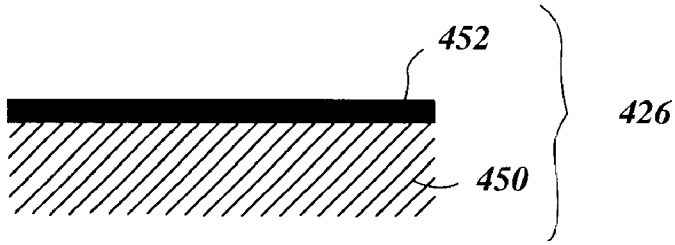
FIGS. 7 and 8 are enlarged section views of exemplary interfaces between materials used in the mounting arrangement of FIG. 4.
Figure 8:
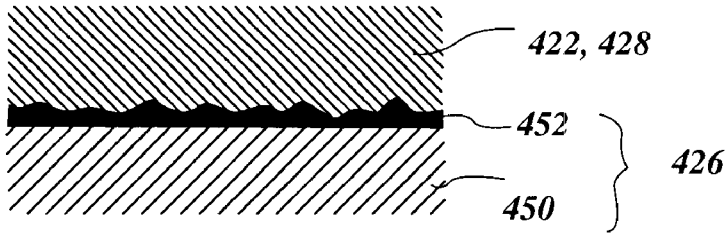

The resin layer 452 acts to better seal the sealing rings 426 against the surface machined components in the mounting arrangement. For instance, as illustrated in FIG. 7, the surface of the resin layer 452 preferably is formed smoothly. After mounting and, in some arrangements, operation of the engine, the resin layer 452 conforms with the surface to which it is mated. In the illustrated arrangement, the resin layer 452 mates with the sealing surface 428 of the fuel injector 114 or the seat 422 of the cylinder head 88. More particularly, when the engine is first operated after installation, the rings are heated by the engine, the rings partially melt and then the rings harden as they cool. Thus, the integrity of the seal is increased after the first operation of the engine. The rings also can be heated using an engine heater or the like. As will be appreciated, the surfaces against which the resin layer 452 mates generally have been machined and, therefore, are not perfectly smooth surfaces. Thus, the resin layer 452 yields and conforms to pits, valleys, surface scratches, grooves and the like to better seal with the respective surfaces 422, 428. The resin layer 452 can be a thermal plastic material or a thermal setting material, depending upon the application. In one arrangement, a thermal setting material is used to reduce the likelihood of cyclical degradation while, in another application, a thermal plastic material is used.

With reference again to FIG. 6, the illustrated sealing rings 426 each also include an eyelet 460. The eyelet 460 extends through a central aperture 462 formed in the sealing ring 426. Of course, in the illustrated arrangement, the central aperture 462 is formed substantially in the geometrical center of the sealing ring 426; however, in some applications, the aperture 462 can be offset if desired. The eyelet 460 preferably is made of a soft metal or other suitable material. For instance, in the illustrated arrangement, the eyelet 460 is formed of aluminum Advantageously, the illustrated eyelets 460 are formed asymmetrically for reasons that will become apparent. More specifically, the eyelets 460 cover more of the outer surfaces 464 of the illustrated rings 426 than the opposite surfaces. In addition, an inner edge 466 that extends through the aperture 462 advantageously has a radius. The structure can vary; however, the selected structure, such as the illustrated structure, results in a construction which, when manufactured from a malleable material, deforms in at least inwardly a radial direction in response to axial forces, such as those illustrated with arrows F. In the preferred arrangement, the expansion is substantially constrained to an inward expansion such that the ring seal is not locked against an outer wall of the bore. This facilitates removal of the ring seal during servicing.

With reference again to FIGS. 4 and 5, when the injector 114 is installed in the mounting bore 400, at least a pair of rings 426 are disposed over the nozzle portion 430 of the fuel injector 114. The sealing rings 426 need not completely fill the outer periphery of the mounting bore 400, as illustrated; however, in some applications, the rings 426 can have a larger outer diameter. Preferably, substantial distance is maintained between the inner wall of the bore 400 and an outer surface of the rings 426 such that the rings 426 can be easily removed from the bore 400 when the fuel injector 114 is replaced.

With the rings 426 positioned over the nozzle 430, the fuel injector in positioned within the bore 400. Thus, the rings 426 are sandwiched between the seat 422 and the sealing surface 428. As the injector 114 is secured in position with the clamp 408, such as by tightening the threaded fastener 410, the sealing rings 426 are squeezed between the seat 422 and the sealing surface 428. The squeezing or compressive forces deform the eyelet 460. In a preferred arrangement, the deformation causes the eyelets to flatten against the injector nozzle 430, as illustrated in FIG. 5. Thus, any gap between the illustrated rings 426 (or eyelets 460) is substantially eliminated. In addition, the rings, when compressed, effectively grip the nozzle 430 of the fuel injector 114 and can be removed with the fuel injector 114 in a single step. Thus, replacement of the fuel injector and sealing arrangement is greatly simplified.

Figure 9:
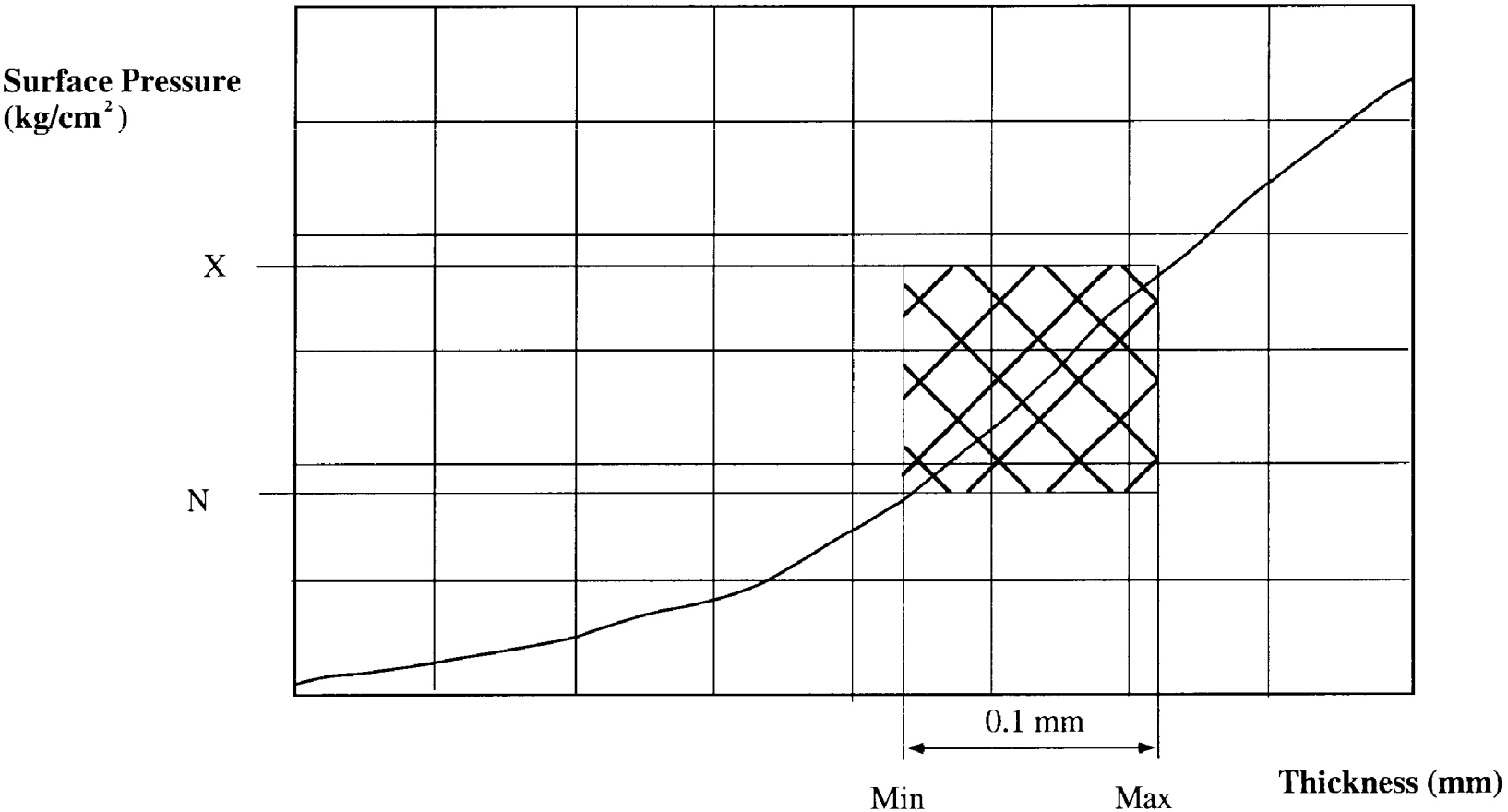
FIG. 9 is a graphical depiction of surface pressure versus the thickness of the seals used in the mounting arrangement of FIG. 4.
Figure 10:
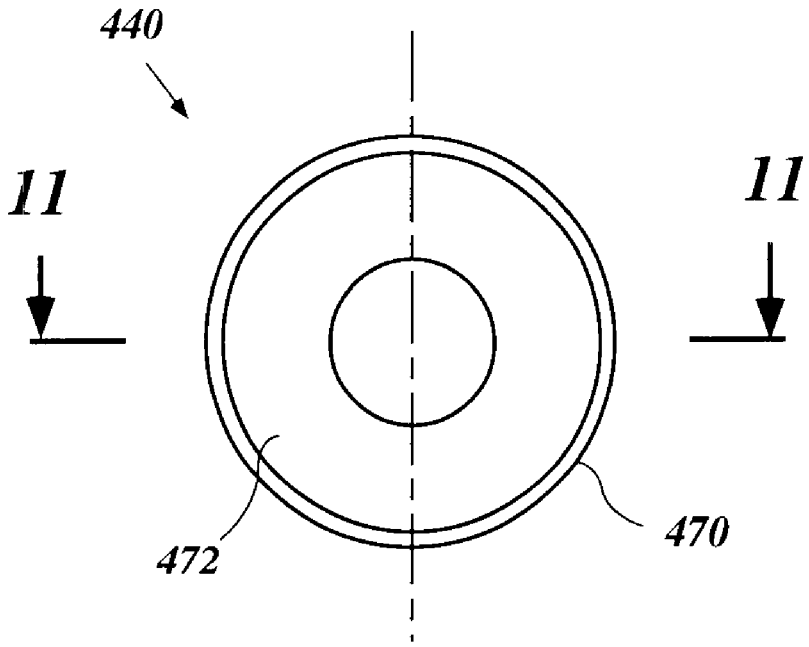
FIG. 10 is a top plan view of a cap used in the mounting arrangement of FIG. 4.
Figure 11:
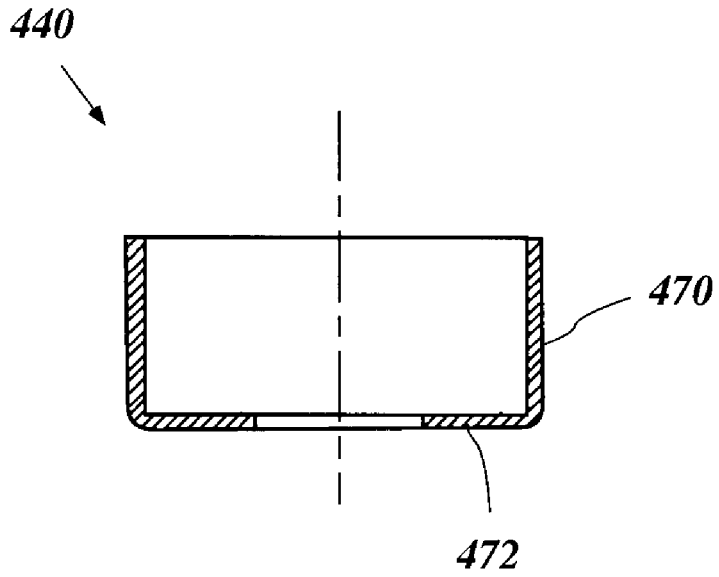
FIG. 11 is a sectioned side elevation view of the cap of FIG. 10.
Figure 12:
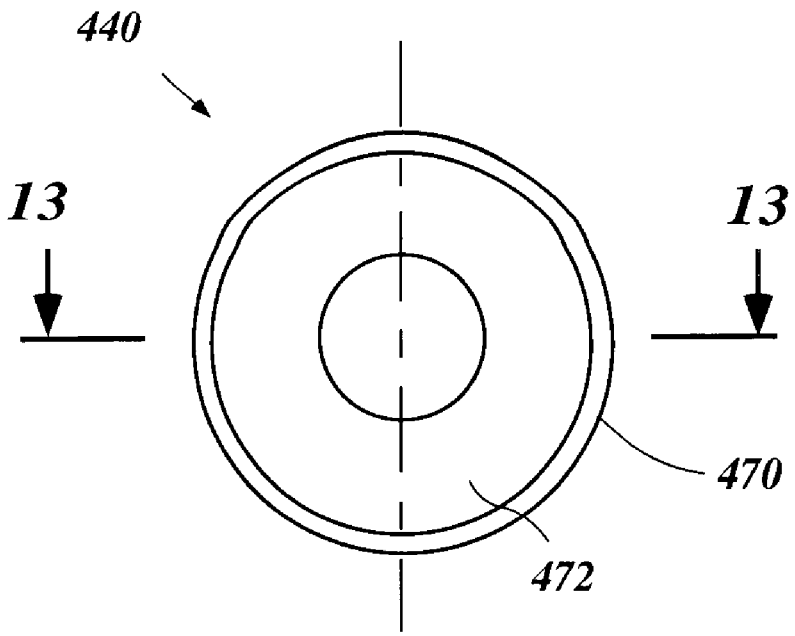
FIG. 12 is a top plan view of another cap having certain features, aspects and advantages in accordance with the present invention.
Figure 13:
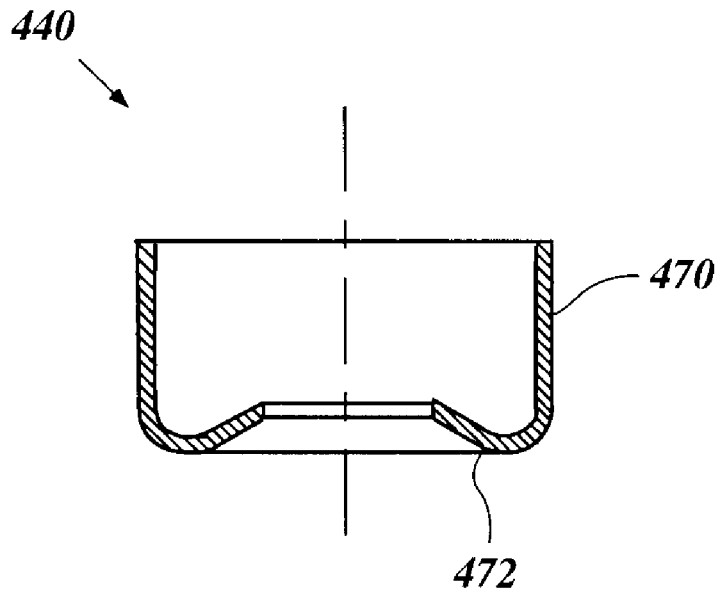
FIG. 13 is a sectioned side elevation view of the cap of FIG. 12.

As will be appreciated, in any given dimensional configuration, varying the thickness of the sealing rings 426 will vary the amount of surface pressure, or compressive forces, developed when mounting the fuel injector 114. With reference now to FIG. 9, a graphical depiction of the compressive forces relative to the thickness of the illustrated rings 426 is illustrated therein. If the surface pressure exceeds a first preset pressure X, then a portion of the fuel injector can be deformed and the fuel injector may not function properly. More specifically, if the fuel injector 114 is deformed, then the fuel throughput of the fuel injector 114 likely will be decreased and the preset amount of fuel will not be properly injected into the engine. Conversely, if the pressure is below a second preset pressure N, then the sealing rings 426 may not adequately seat against the injector nozzle 430. In the illustrated arrangement, the difference between the two preset pressures X, N corresponds to a difference of 0.1 mm per ring in thickness at the rings 426. Thus, either the thickness of the rings, or the design of the fuel injector 114 and the cylinder head 88 can be determined to maintain the surface pressure within the acceptable range. Preferably, to expand the envelope and to accommodate manufacturing tolerances, the acceptable amount of compression is doubled by using two rings 426. Of course, a single ring can be used; however, the use of two rings increases the available tolerance range due to the characteristics of the composite materials of the rings. Preferably, the total thickness of the pair of rings 426 in the illustrated arrangement is at least about ⅓ of the diameter of the nozzle 430.

With reference now to FIGS. 10–13, two presently preferred caps 440 are illustrated therein. The caps 440 preferably are formed by removing material; however, it will be understood that the caps 440 can be formed in any other suitable manner (i.e., upset forming, forging, molding, turning, etc.). Each cap generally comprises at least one side wall 470 and a base ring 472. The two components can be integrally formed or can be separately formed and attached together.

With reference to FIG. 5, the illustrated base ring 472 of the cap 440 advantageously covers the peripheral portions of the injector nozzle 430. As such, the base rings 472 are generally flat and have an opened center through which the fuel is injected into the combustion chamber 110. The two base rings 472 of the illustrated caps 440 differ in the flatness of the base rings 472. Generally, the difference in the rings 472 results from the manufacturing processes used to make the rings; however, both rings perform their role adequately.

The side wall 470 in the illustrated arrangement is substantially cylindrical. It is anticipated that the side wall 470 can also be other shapes depending upon the application. The side wall 470 is sized and configured to extend along a portion of the nozzle 430, as described above. In addition, an inner diameter of the side wall 470 is slightly greater than an outside diameter of the nozzle 430. One presently preferred construction preferably forms a gap (which can be greater than about 0.1 mm) between the inner diameter of the side wall 470 and the nozzle 430. More preferably, the side wall 470 is sized such that the gap between the side wall 470 and the nozzle 430 is larger than a gap between the side wall 470 and the sub-bore portion 442. Generally, the cap 440 is loosely fitted over the nozzle 430 and is capable of movement relative to the nozzle 430. In this manner, when the engine begins operation, the base ring 472 moves toward the nozzle 430 due to the pressure developing within the combustion chamber 110. Thus, the base ring 472 is driven toward the nozzle 430 to better seal against the nozzle 430. Such a construction advantageously reduces the propagation of flames alongside of the nozzle 430.

Generally, during prolonged operation of the engine, heavy components of the fuel are deposited between the cap 440 and the cylinder head 88. Thus, the cap 440 is secured in the slightly raised position (i.e., the position to which it is driven by the combustion chamber pressure). Advantageously, in this position, the gap formed between the cap 440 and the nozzle 430 forms an insulating layer of air between nozzle of the fuel injector 114 and the mounting arrangement. Thus, heat is not directly transferred to the fuel injector 114 from the combustion chamber 110.

Thus, the present mounting arrangement greatly improves the seal between the cylinder head 88 and the fuel injector 114. In addition, the present mounting arrangement creates an insulating pocket of air between the fuel injector nozzle and the cylinder head while supporting the fuel injector above the seat of the cylinder head with heat insulating materials.

Although the present invention has been described in terms of certain preferred arrangements, other arrangements and applications apparent to those of ordinary skill in the art also are within the scope of this invention. Thus, various changes, modifications, and alterations may be made in the above-described embodiments without departing from the spirit and scope of the invention. Moreover, not all the features, aspects, and advantages are necessarily required to practice the present invention. Therefore, some of the features, aspects, and advantages may be separately practiced from other features, aspects, and advantages while still practicing a part or all of the above-described invention. Accordingly, the scope of the present invention is intended to be defined only by the claims that follow.

What is claimed is:

1. A direct injected engine comprising a cylinder, a cylinder head being mounted to said cylinder, a piston being disposed within said cylinder, a combustion chamber being defined at least in part by said piston, said cylinder and said cylinder head, a mounting bore extending through said cylinder head, a fuel injector copending through said mounting bore, said mounting bore including a stepped seat surface, said fuel injector comprising a nozzle extending between a tip and a seating surface, said nozzle comprising a fuel injection port that is disposed to inject fuel directly into said combustion chamber, at least one sealing ring being disposed about said fuel injector between said seating surface and said seat surface, said sealing ring comprising a thermal insulating component and having a smaller outer diameter than an outer diameter of said seat surface.

2. The engine of claim 1, wherein said ring comprises a deformable component that is adapted to deform in an inward radial direction in response to axial forces.

3. The engine of claim 2, wherein said deformable component is an eyelet.

4. The engine of claim 3, wherein said eyelet is made of a malleable metal.

5. The engine of claim 1, wherein said ring comprises a resin layer that is positioned adjacent said seat surface.

6. The engine of claim 1, wherein said ring comprises a resin layer that is positioned adjacent said seating surface.

7. The engine of claim 1, wherein said ring comprises a resin layer that is positioned adjacent said seating surface and said seat surface.

8. The engine of claim 1, comprising a pair of rings.

9. The engine of claim 8, wherein said rings each comprise an eyelet, said eyelets being asymmetric such that a said eyelet covers more of a first side of the associated ring than of a second side and said first sides of said rings are positioned apart from one another while said second sides of said rings are positioned toward one another.

10. The engine of claim 1, further comprising an injector nozzle cap, said cap having a ring shaped base and a side wall, said side wall encircling a portion of said nozzle and said base covering a peripheral portion of said tip.

11. The engine of claim 10, wherein said base is substantially flat.

12. The engine of claim 10, wherein said base is slightly curved such that said base forms a convex surface extending toward said combustion chamber.

13. A direct injected engine comprising a cylinder, a cylinder head being mounted to said cylinder, a piston being disposed within said cylinder, a combustion chamber being defined at least in part by said piston, said cylinder and said cylinder head, a mounting bore extending through said cylinder head, a fuel injector depending through said mounting bore, said mounting bore including a stepped seat surface, said fuel injector comprising a nozzle extending between a tip and a seating surface, said nozzle comprising a fuel injection port that is disposed to inject fuel directly into said combustion chamber, at least one sealing ring being disposed about said fuel injector between said seating surface and said seat surface, said sealing ring comprising a first layer of heat insulating material, a second outer layer of a thermally activatable material and having an outer diameter less than an outer diameter of said seat surface.

14. The engine of claim 13, wherein said heat insulating material is asbestos.

15. The engine of claim 13, wherein said thermally activatable material is a thermal set plastic.

16. The engine of claim 13, wherein said thermally activatable material comprises resin.

17. The engine of claim 13, wherein said second layer substantially encases said first layer.

18. The engine of claim 13 further comprising an aperture extending through said sealing ring and an eyelet extending through said aperture.

19. The engine of claim 18, wherein said eyelet is made of a malleable material.

20. The engine of claim 18, wherein said eyelet is asymmetrical such that said eyelet covers a greater portion of a first side of said ring than a second side of said ring.

21. The engine of claim 18, wherein said eyelet is made of a metal.

22. The engine of claim 18, wherein said eyelet has a radius surface extending between a first side of said ring and a second side of said ring.

23. A direct injected engine comprising a cylinder, a cylinder head being mounted to said cylinder, a combustion chamber being defined at least in part by said cylinder head, a mounting bore extending through said cylinder head, said mounting bore comprising a stepped seat surface, a fuel injector having an upper portion and a lower portion, the lower portion extending into said mounting bore, said lower portion comprising a seating surface and a fuel injection nozzle, said fuel injection nozzle disposed to inject fuel directly into said combustion chamber, a pair of sealing rings being disposed about said fuel injector between said seating surface and said seat surface, said sealing rings each comprising a first layer of heat insulating material a second outer layer of a thermally activatable material, and each sealing ring having an outer diameter less than an outer diameter of said seat surface.

24. The engine of claim 14, wherein said heat insulating material is asbestos.

25. The engine of claim 14, wherein said thermally activatable material is a thermal set plastic.

26. The engine of claim 14, wherein said thermally activatable material comprises resin.

27. The engine of claim 14, wherein said second layer substantially encases said first layer.

28. The engine of claim 14 further comprising an aperture extending through each of said sealing rings and an eyelet extending through each of said apertures.

29. The engine of claim 28, wherein said eyelet is made of a malleable material.

30. The engine of claim 28, wherein said eyelet are asymmetrical such that a first of said eyelets covers a greater portion of a first side of a first of said rings than a second side of said first of said rings and a second of said eyelets covers a greater portion of a second side of a second of said rings than a first side of said first of said rings and said second side of said first of said rings and said first side of said second of said rings are placed in abutment.

31. The engine of claim 28, wherein said eyelets are made of a metal.

* * * * *

UNITED STATES PATENT AND TRADEMARK OFFICE

CERTIFICATE OF CORRECTION

PATENT NO. : 6,427,667 B1
DATED : August 6, 2002
INVENTOR(S) : Masahiko Kato

It is certified that error appears in the above-identified patent and that said Letters Patent is hereby corrected as shown below:

Column 14,
Line 66, "copending" should be -- depending --

Signed and Sealed this

Eighth Day of July, 2003

JAMES E. ROGAN
*Director of the United States Patent and Trademark Office*